US006535167B2

(12) United States Patent
Masuda et al.

(10) Patent No.: US 6,535,167 B2
(45) Date of Patent: Mar. 18, 2003

(54) LAMINATE PATTERN ANTENNA AND WIRELESS COMMUNICATION DEVICE EQUIPPED THEREWITH

(75) Inventors: Yoshiyuki Masuda, Tokyo (JP); Hisamatsu Nakano, 4-6-7-101, Jyousuiminami-Cho, Kodaira-Shi, Tokyo (JP)

(73) Assignees: Sharp Kabushiki Kaisha, Osaka (JP); Hisamatsu Nakano, Tokyo (JP)

( * ) Notice: Subject to any disclaimer, the term of this patent is extended or adjusted under 35 U.S.C. 154(b) by 0 days.

(21) Appl. No.: 09/859,449

(22) Filed: May 18, 2001

(65) Prior Publication Data

US 2001/0043159 A1 Nov. 22, 2001

(30) Foreign Application Priority Data

May 18, 2000 (JP) ..... 2000-146292

(51) Int. Cl.[7] ..... H01Q 1/38
(52) U.S. Cl. ..... 343/700 MS; 343/702
(58) Field of Search ..... 343/702, 700 MS, 343/895, 893, 845, 846, 847, 826, 853; H01Q 1/38

(56) References Cited

U.S. PATENT DOCUMENTS 5,966,097 A * 10/1999 Fukasawa et al. ... 343/700 MS
6,025,805 A * 2/2000 Smith et al. ..... 343/702
6,028,567 A * 2/2000 Lahti ..... 343/895
6,054,955 A * 4/2000 Schlegel, Jr. et al. ..... 343/702
6,204,819 B1 * 3/2001 Hayes et al. ..... 343/702
6,255,994 B1 * 7/2001 Saito ..... 343/700 MS
6,320,545 B1 * 11/2001 Nagumo et al. ..... 343/700 MS
6,326,924 B1 * 12/2001 Muramoto et al. ..... 343/702
6,337,662 B1 * 1/2002 Cassel ..... 343/702

FOREIGN PATENT DOCUMENTS

| | | | |
|---|---|---|---|
| JP | 5-347511 | 12/1993 | |
| JP | 6-69715 | 3/1994 | |
| JP | 6-334421 | 12/1994 | |
| JP | 59132 | 2/2000 | |
| SE | WO 98/49742 | * 11/1998 | ..... H01Q/1/38 |

* cited by examiner

*Primary Examiner*—Don Wong
*Assistant Examiner*—Trinh Do Dinh
(74) *Attorney, Agent, or Firm*—Birch, Stewart, Kolasch & Birch, LLP

(57) ABSTRACT

An inverted-F-shaped antenna pattern is formed as a driven element on the obverse-side surface of a glass-epoxy circuit board. This antenna pattern has a feeding conductor pattern connected to a feeding transmission path formed on the obverse-side surface of the circuit board and a grounding conductor pattern connected to a grounding conductor portion formed on the obverse-side surface of the circuit board. Moreover, an inverted-L-shaped antenna pattern is formed as a passive element on the reverse-side surface of the circuit board. This antenna pattern has a grounding conductor pattern connected to a grounding conductor portion formed on the reverse-side surface of the circuit board. Forming the inverted-F-shaped antenna pattern and the inverted-L-shaped antenna pattern so as to overlap each other yields a laminate pattern antenna that is usable in a wide frequency range.

46 Claims, 10 Drawing Sheets

LAMINATE PATTERN ANTENNA AND WIRELESS COMMUNICATION DEVICE EQUIPPED THEREWITH

BACKGROUND OF THE INVENTION

1. Field of the Invention

The present invention relates to a pattern antenna formed on a circuit board. The present invention relates particularly to a laminate pattern antenna that is compact and lightweight but that nevertheless permits wide-range transmission and reception, and to a wireless communication device equipped with such a laminate pattern antenna.

2. Description of the Prior Art

In mobile communication using compact wireless devices such as cellular phones or indoor wireless LAN (local area network) terminals, those wireless devices need to be equipped with compact, high-performance antennas. As compact antennas for such applications, slim planar antennas have been receiving much attention because they can be incorporated in devices. As planar antennas are used microstrip antennas, of which typical examples are short-circuiting microstrip antennas as shown in FIG. 20A and planar inverted-F antennas as shown in FIG. 20B. In recent years, as wireless devices are made increasingly compact, planar antennas obtained by further miniaturizing microstrip antennas as shown in FIG. 20A have been proposed, for example, in Japanese Patent Applications Laid-Open Nos. H5-347511 and 2000-59132.

Inverted-F-shaped wire-form antennas as shown in FIGS. 21A and 21B are also used. FIG. 21A is a top view of an inverted-F-shaped antenna 101 of which a grounding conductor portion 103 is connected to a grounding conductor plate 102. FIG. 21B is a sectional view of the inverted-F-shaped antenna 101, and shows that a current is fed to a feeder conductor portion 104 of the inverted-F-shaped antenna 101. However, as the graph shown in FIG. 22 indicates, an inverted-F-shaped antenna 101 like the one shown in FIGS. 21A and 21B is usable only in a narrow frequency range. FIG. 22 is a diagram showing the frequency response of the voltage standing wave ratio (VSWR) of the inverted-F-shaped antenna 101 shown in FIGS. 21A and 21B. A wire-form antenna obtained by making this type of antenna usable in a wider frequency range is proposed in Japanese Patent Application Laid-Open No. H6-69715.

As described above, the antennas proposed in Japanese Patent Applications Laid-Open Nos. H5-347511, 2000-59132, and H6-69715 are miniaturized as compared with common planar or linear (wire-form) antennas that have conventionally been used. However, any of these antennas is formed three-dimensionally on a circuit board, and thus requires a space dedicated thereto on the circuit board to which it is grounded. This sets a limit to the miniaturization of these types of antenna.

On the other hand, Japanese Patent Application Laid-Open No. H6-334421 proposes a wireless communication product that employs a circuit-board-mounted antenna such as an inverted-L-shaped printed pattern antenna. However, on its own, an inverted-L-shaped printed pattern antenna is usable only in a narrow frequency range as described above. According to another proposal, an inverted-L-shaped printed pattern antenna is used together with a microstrip-type planar antenna to make it usable in a wider frequency range. However, this requires an unduly large area to be secured for the antennas, and thus hinders their miniaturization.

SUMMARY OF THE INVENTION

An object of the present invention is to provide a laminate pattern antenna that is miniaturized by the use of a pattern antenna that is formed as a pattern on the surface or inside a circuit board, and to provide a wireless device equipped with such a laminate pattern antenna.

Another object of the present invention is to provide a laminate pattern antenna that is made usable in a wider frequency range by the use of a plurality of pattern antennas, and to provide a wireless device equipped with such a laminate pattern antenna.

To achieve the above objects, according to one aspect of the present invention, a laminate pattern antenna formed on a circuit board is provided with: a first antenna pattern formed as a driven element on a first surface of the circuit board; and a second antenna pattern formed as a passive element on a second surface of the circuit board.

According to another aspect of the present invention, a laminate pattern antenna formed on and in a multilayer circuit board is provided with: a plurality of first antenna patterns formed as a driven element on the surfaces of or at the interfaces between the layers constituting the circuit board; and a plurality of second antenna patterns formed as a passive element on the surfaces of or at the interfaces between the layers constituting the circuit board.

According to another aspect of the present invention, a wireless communication device is provided with: a laminate pattern antenna that permits at least either transmission or reception of a communication signal to or from an external device This laminate pattern antenna is provided with: a first antenna pattern formed as a driven element on a first surface of the circuit board; and a second antenna pattern formed as a passive element on a second surface of the circuit board.

According to another aspect of the present invention, a wireless communication device is provided with: a laminate pattern antenna that permits at least either transmission or reception of a communication signal to or from an external device. This laminate pattern antenna is provided with: a plurality of first antenna patterns formed as a driven element on the surfaces of or at the interfaces between the layers constituting the circuit board; and a plurality of second antenna patterns formed as a passive element on the surfaces of or at the interfaces between the layers constituting the circuit board.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, embodiments of the present invention will be described.

First Embodiment

Figure 1:
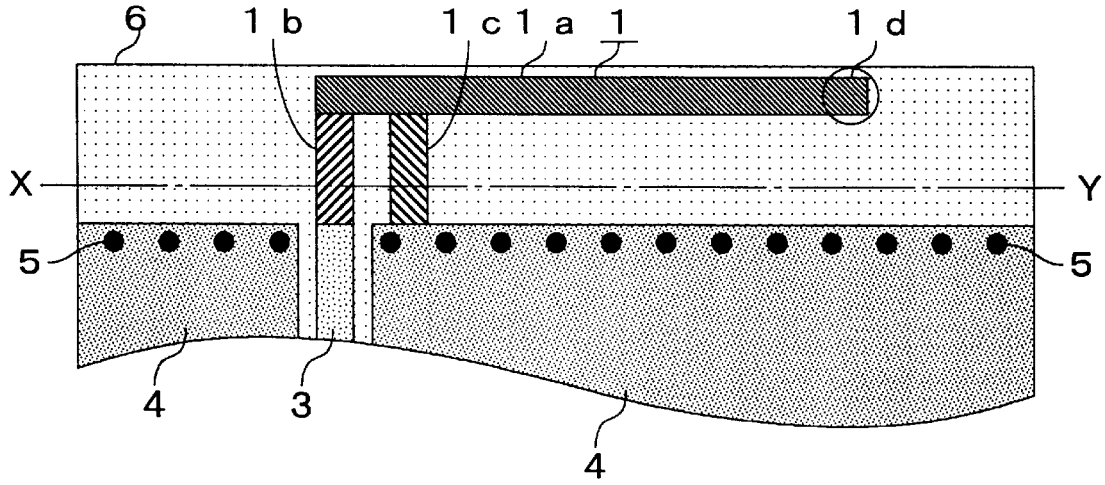
FIG. 1 is a plan view showing the configuration of the inverted-F-shaped antenna pattern in the laminate pattern antenna of a first embodiment of the invention.
Figure 2:
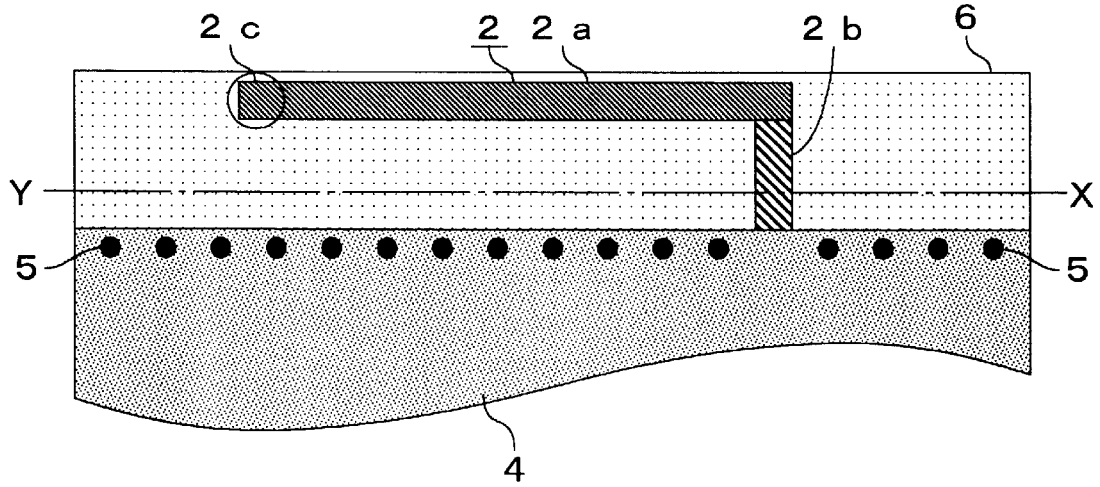
FIG. 2 is a plan view showing the configuration of the inverted-L-shaped antenna pattern in the laminate pattern antenna of the first embodiment.
Figure 3:
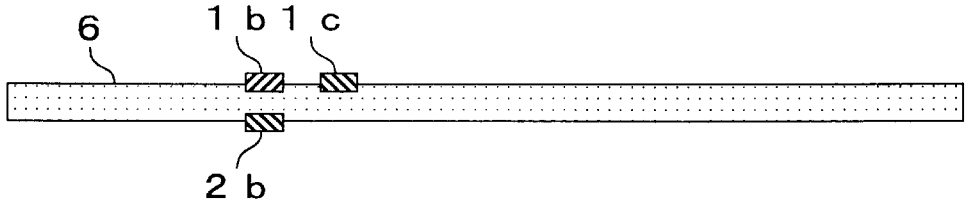
FIG. 3 is a sectional view showing the configuration of the laminate pattern antenna of the first embodiment.
Figure 4:
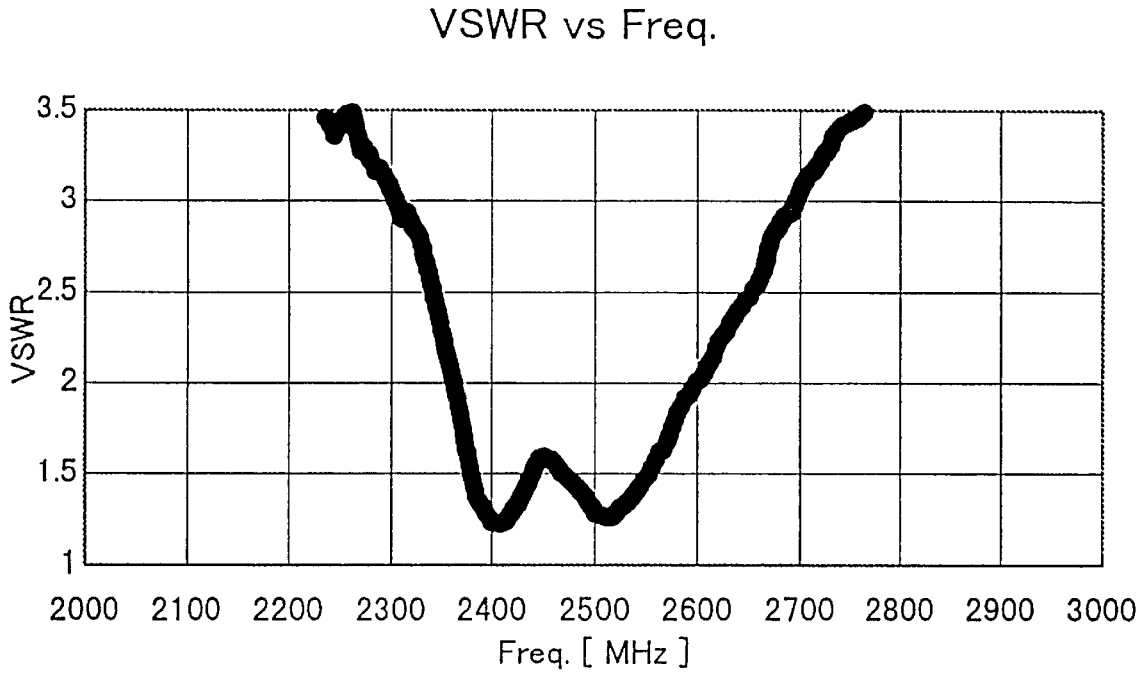
FIG. 4 is a diagram showing the frequency response of the voltage standing wave ratio of the laminate pattern antenna of the first embodiment.

A first embodiment of the invention will be described below with reference to the drawings. FIG. 1 is a diagram showing the obverse-side surface of the laminate pattern antenna of this embodiment. FIG. 2 is a diagram showing the reverse-side surface of the laminate pattern antenna of this embodiment. FIG. 3 is a sectional view of the laminate pattern antenna of this embodiment, taken along line X-Y shown in FIGS. 1 and 2. FIG. 4 is a graph showing the frequency response of the voltage standing wave ratio (VSWR) of the laminate pattern antenna of this embodiment.

The laminate pattern antenna of this embodiment is composed of an inverted-F-shaped antenna pattern 1 formed on the obverse-side surface of a glass-epoxy (i.e. glass-fiber-reinforced epoxy resin) circuit board 6 as shown in FIG. 1 and an inverted-L-shaped antenna pattern 2 formed on the reverse-side surface of the circuit board 6 as shown in FIG. 2. The inverted-F-shaped antenna pattern 1 and the inverted-L-shaped antenna pattern 2 are formed in an edge portion of the circuit board 6, which has other circuit patterns and the like also formed thereon.

As shown in FIG. 1, on the obverse-side surface of the circuit board 6, two grounding conductor portions 4 are formed, and, between these two grounding conductor portions 4, a feeding transmission path 3 is formed. In peripheral portions of the grounding conductor portions 4, through holes 5 are formed that permit the grounding conductor portions 4 to be connected to other circuit patterns. As shown in FIG. 2, on the reverse-side surface of the circuit board 6, as on the obverse-side surface thereof, a grounding conductor portion 4 is formed with through holes 5 formed in a peripheral portion thereof. The grounding conductor portions 4 on the obverse-side surface of the circuit board 6 are formed so as to overlap the grounding conductor portion 4 on the reverse-side surface of the circuit board 6 with the material of the circuit board 6 sandwiched in between.

As shown in FIG. 1, the inverted-F-shaped antenna pattern 1 formed on the obverse-side surface of the circuit board 6 consists of an elongate pattern 1*a* that is formed parallel to a side edge of the grounding conductor portion 4 that faces it, a feeding conductor pattern 1*b* that is connected at one end to the end of the elongate pattern 1*a* opposite to the open end 1*d* thereof and that is connected at the other end to the feeding transmission path 3, and a grounding conductor pattern 1*c* that is connected at one end to a point on the elongate pattern 1*a* between the open end 1*d* of the elongate pattern 1*a* and the feeding conductor pattern 1*b* and that is connected at the other end to the grounding conductor portion 4.

As shown in FIG. 2, the inverted-L-shaped antenna pattern 2 formed on the reverse-side surface of the circuit board 6 consists of an elongate pattern 2*a* that is formed parallel to a side edge of the grounding conductor portion 4 that faces it, and a grounding conductor pattern 2*b* that is connected at one end to the end of the elongate pattern 2*a* opposite to the open end 2*c* thereof and that is connected at the other end to the grounding conductor portion 4. The inverted-L-shaped antenna pattern 2 is formed so as to overlap the inverted-F-shaped antenna pattern 1 with the circuit board 6, i.e. the material thereof, sandwiched in between in such a way that the elongate pattern 2*a* of the inverted-L-shaped antenna pattern 2 is located directly below the elongate pattern 1*a* of the inverted-F-shaped antenna pattern 1 and in addition that, as shown in the sectional view in FIG. 3, the grounding conductor pattern 2*b* of the inverted-L-shaped antenna pattern 2 is located directly below the feeding conductor pattern 1*b* of the inverted-F-shaped antenna pattern 1.

Here, the path length Lp from the open end 2*c* of the elongate pattern 2*a* of the inverted-L-shaped antenna pattern 2 to the grounding conductor pattern 2*b* and then to the grounding conductor portion 4 is set to be slightly longer than the path length Li from the open end 1*d* of the elongate pattern 1*a* of the inverted-F-shaped antenna pattern 1 to the grounding conductor pattern 1*c* and then to the grounding conductor portion 4. More specifically, if the effective wavelength of the antenna at the center frequency of the usable frequency range thereof is assumed to be $\lambda$, then the path lengths Li and Lp are so set as to fulfill $0.236\times\lambda \leqq Li < 0.25\times\lambda$ and $0.25\times \leqq Lp < 0.273\times\lambda$.

Moreover, it is preferable that the gap between each of the elongate patterns 1*a* and 2*a* of the inverted-F-shaped and inverted-L-shaped antenna patterns 1 and 2 and the grounding conductor portion 4 be 0.02×λ or wider. The reason is that, just as the usable frequency range of an inverted-F-shaped or similar antenna becomes narrower as the gap between its radiator plate and grounding conductor portion becomes narrower, the usable frequency range of the laminate pattern antenna under discussion becomes narrower as the gap between each of the inverted-F-shaped and inverted-L-shaped antenna patterns 1 and 2 and the grounding conductor portion 4 becomes narrower. (The results of simulations performed to observe how those gaps with respect to the grounding conductor portion 4 affect the frequency response of the voltage standing wave ratio of the laminate pattern antenna will be described later.) Furthermore, it is preferable that the inverted-F-shaped and inverted-L-shaped antenna patterns 1 and 2 constituting the laminate pattern antenna each have a pattern line width of 0.5 mm or more, in consideration of the accuracy with which the patterns are formed.

Formed as described above, the inverted-F-shaped and inverted-L-shaped antenna patterns 1 and 2 act respectively as a driven element to which electrical energy is fed and as a passive element that is driven by the inverted-F-shaped antenna pattern 1 acting as the driven element. Moreover, the path lengths of the inverted-F-shaped and inverted-L-shaped antenna patterns 1 and 2 are set to be two values that deviate from 0.25×λ in opposite directions. As a result, when considered individually, the inverted-F-shaped and inverted-L-shaped antenna patterns 1 and 2 have their usable frequency ranges shifted to the low-frequency and high-frequency sides, respectively, of the center frequency of the usable frequency range of the laminate pattern antenna as a whole, i.e. the frequency that corresponds to the effective wavelength λ thereof.

Figure 22:
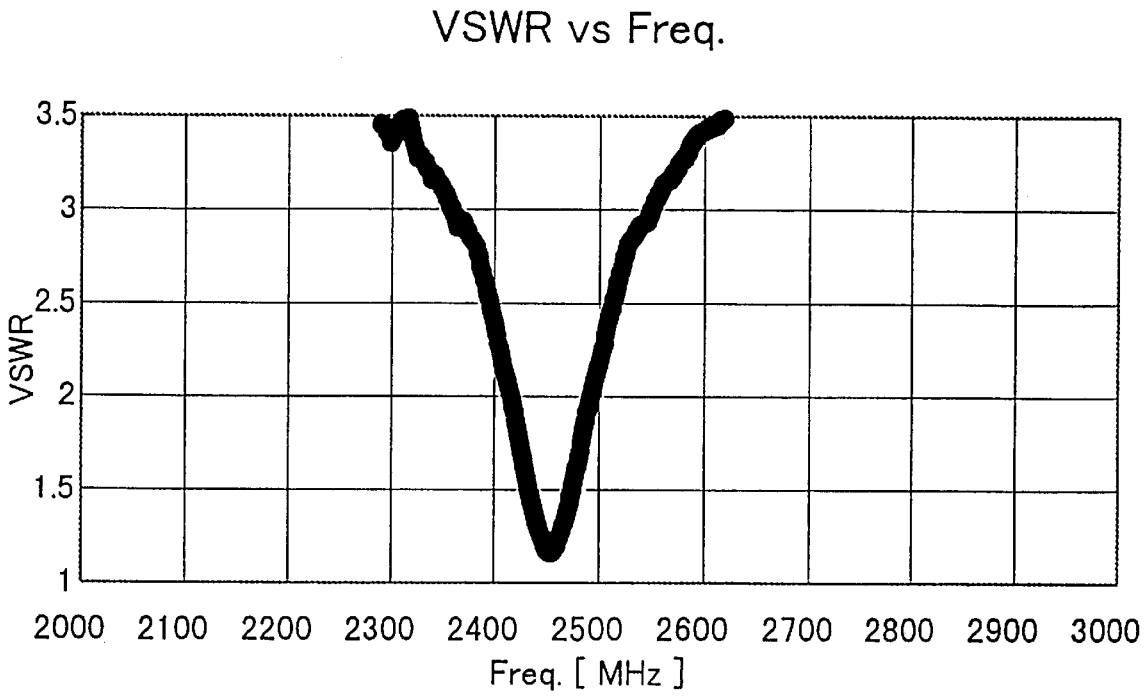
FIG. 22 is a diagram showing the frequency response of the voltage standing wave ratio of a conventional inverted-F-shaped antenna.

The inverted-F-shaped and inverted-L-shaped antenna patterns 1 and 2, having their usable frequency ranges shifted to the low-frequency and high-frequency sides, respectively, of the center frequency of the usable frequency range of the laminate pattern antenna as a whole, i.e. the frequency that corresponds to the effective wavelength λ thereof, as described above, affect each other. As a result, in the laminate pattern antenna configured as described above, the voltage standing wave ratio exhibits frequency response as shown in FIG. 4, offering a wider frequency range in which VSWR<2 than is obtained conventionally (FIG. 22). This makes it possible to achieve satisfactory impedance matching in a wide frequency range and thereby transmit and receive communication signals in a wide frequency range.

Second Embodiment

Figure 5:
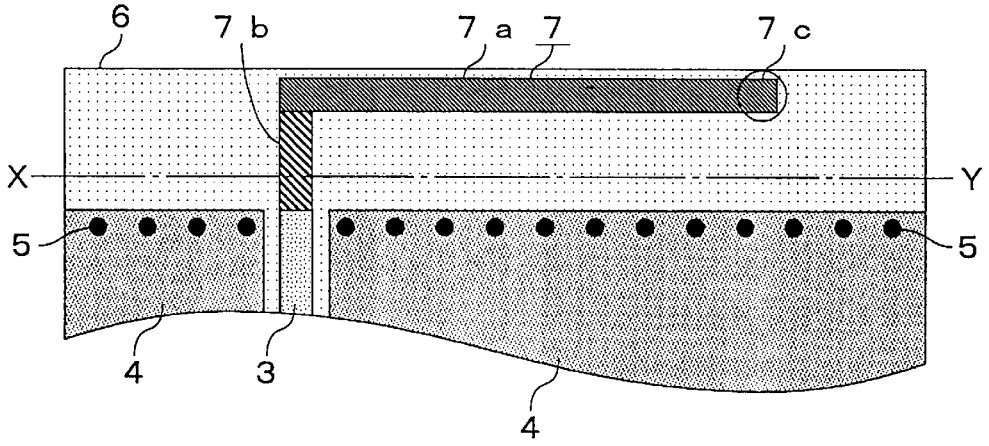
FIG. 5 is a plan view showing the configuration of one inverted-L-shaped antenna pattern in the laminate pattern antenna of a second embodiment of the invention.
Figure 6:
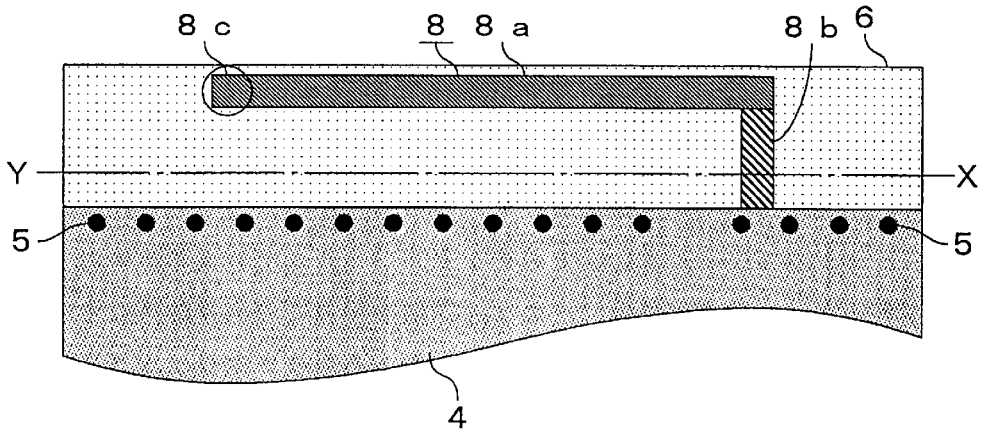
FIG. 6 is a plan view showing the configuration of the other inverted-L-shaped antenna pattern in the laminate pattern antenna of the second embodiment.
Figure 7:
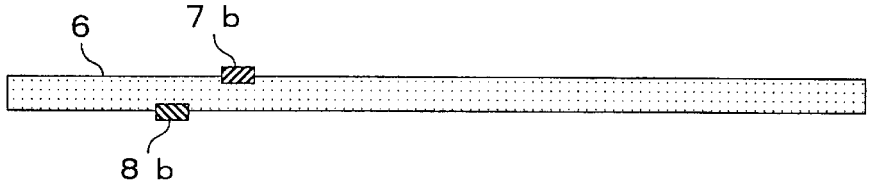
FIG. 7 is a sectional view showing the configuration of the laminate pattern antenna of the second embodiment.
Figure 8:
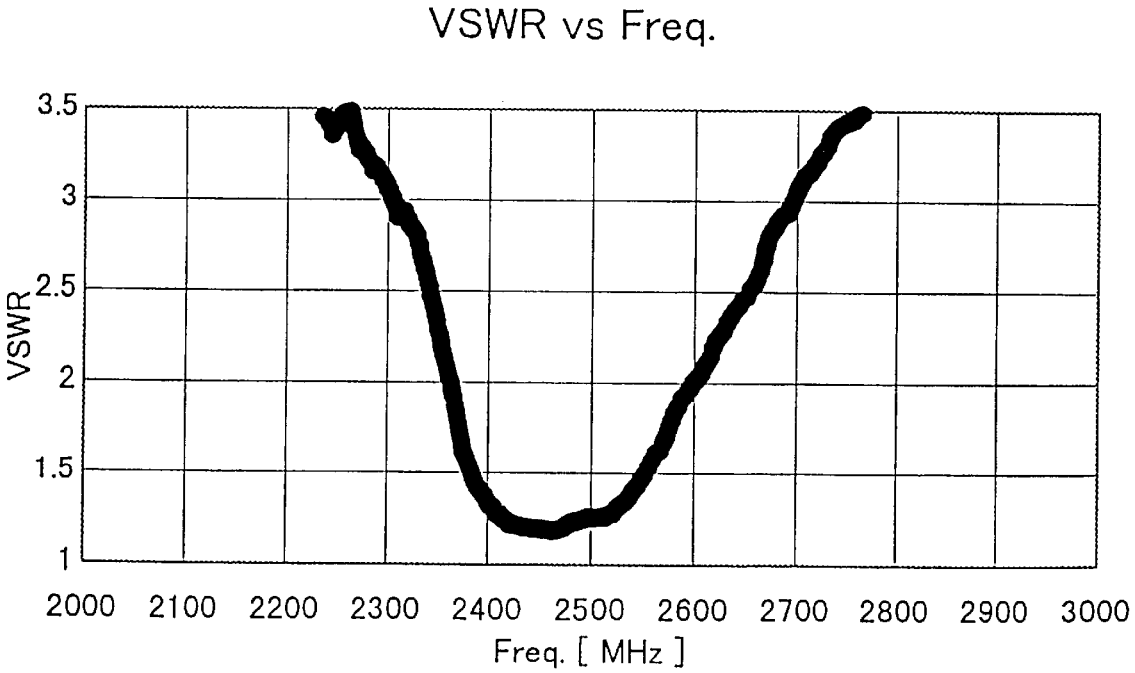
FIG. 8 is a diagram showing the frequency response of the voltage standing wave ratio of the laminate pattern antenna of the second embodiment.

A second embodiment of the invention will be described below with reference to the drawings. FIG. 5 is a diagram showing the obverse-side surface of the laminate pattern antenna of this embodiment. FIG. 6 is a diagram showing the reverse-side surface of the laminate pattern antenna of this embodiment. FIG. 7 is a sectional view of the laminate pattern antenna of this embodiment, taken along line X-Y shown in FIGS. 5 and 6. FIG. 8 is a graph showing the frequency response of the voltage standing wave ratio (VSWR) of the laminate pattern antenna of this embodiment. In the following descriptions, such elements as are used for the same purposes as in the laminate pattern antenna of the first embodiment are identified with the same reference numerals, and their detailed explanations will not be repeated.

The laminate pattern antenna of this embodiment is composed of an inverted-L-shaped antenna pattern 7 formed on the obverse-side surface of a glass-epoxy circuit board 6 as shown in FIG. 5 and an inverted-L-shaped antenna pattern 8 formed on the reverse-side surface of the circuit board 6 as shown in FIG. 6. The inverted-L-shaped antenna pattern 7 and the inverted-L-shaped antenna pattern 8 are formed in an edge portion of the circuit board 6, which has other circuit patterns and the like also formed thereon. On the obverse-side surface of the circuit board 6 are formed, as in the first embodiment (FIG. 1), a feeding transmission path 3 and a grounding conductor portion 4 with through holes 5 formed in a peripheral portion thereof. On the reverse-side surface of the circuit board 6 is formed, as in the first embodiment (FIG. 2), a grounding conductor portion 4 with through holes 5 formed in a peripheral portion thereof.

As shown in FIG. 5, the inverted-L-shaped antenna pattern 7 formed on the obverse-side surface of the circuit board 6 consists of an elongate pattern 7*a* that is formed parallel to a side edge of the grounding conductor portion 4 that faces it, and a feeding conductor pattern 7*b* that is connected at one end to the end of the elongate pattern 7*a* opposite to the open end 7*c* thereof and that is connected at the other end to the feeding transmission path 3. As shown in FIG. 6, the inverted-L-shaped antenna pattern 8 formed on the reverse-side surface of the circuit board 6 consists of, as in the first embodiment, an elongate pattern 8*a* that is formed parallel to a side edge of the grounding conductor portion 4 that faces it, and a grounding conductor pattern 8*b* that is connected at one end to the end of the elongate pattern 8*a* opposite to the open end 8*c* thereof and that is connected at the other end to the grounding conductor portion 4.

The inverted-L-shaped antenna pattern 8 is formed so as to overlap the inverted-L-shaped antenna pattern 7 with the circuit board 6, i.e. the material thereof, sandwiched in between in such a way that the open end 8*c* of the inverted-L-shaped antenna pattern 8 is located directly below the open end 7*c* of the inverted-L-shaped antenna pattern 7 and in addition that, as shown in the sectional view in FIG. 7, the grounding conductor pattern 8*b* of the inverted-L-shaped antenna pattern 8 does not overlap the feeding conductor pattern 7*b* of the inverted-L-shaped antenna pattern 7.

Here, as in the first embodiment, the path length Lp from the open end 8*c* of the elongate pattern 8*a* of the inverted-L-shaped antenna pattern 8 to the grounding conductor pattern 8*b* and then to the grounding conductor portion 4 is set to be slightly longer than the path length Li from the open end 7*c* of the elongate pattern 7*a* of the inverted-L-shaped antenna pattern 7 to the feeding conductor pattern 7*b* and then to the feeding transmission path 3. More specifically, if the effective wavelength of the antenna at the center frequency of the usable frequency range thereof is assumed to be λ, then the path lengths Li and Lp are so set as to fulfill $0.236\times\lambda \leqq Li < 0.25\times\lambda$ and $0.25\times\lambda \leqq Lp < 0.273\times\lambda$.

Moreover, as in the first embodiment, it is preferable that the gap between each of the elongate patterns 7*a* and 8*a* of the inverted-L-shaped antenna patterns 7 and 8 and the grounding conductor portion 4 be 0.02×λ or wider. Furthermore, it is preferable that the inverted-L-shaped antenna patterns 7 and 8 constituting the laminate pattern antenna each have a pattern line width of 0.5 mm or more, in consideration of the accuracy with which the patterns are formed.

In the laminate pattern antenna configured as described above, the inverted-L-shaped antenna pattern 7 acts as a driven element, and the inverted-L-shaped antenna pattern 8 acts as a passive element. As a result, in this laminate pattern antenna, the voltage standing wave ratio exhibits frequency response as shown in FIG. 8, offering, as in the first embodiment (FIG. 4), a wider frequency range in which VSWR<2 than is obtained conventionally (FIG. 22). This makes it possible to achieve satisfactory impedance matching in a wide frequency range and thereby transmit and receive communication signals in a wide frequency range.

Third Embodiment

Figure 9:
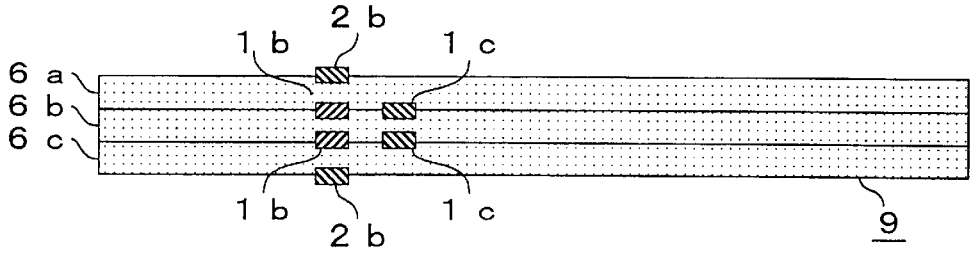
FIG. 9 is a sectional view showing the configuration of the laminate pattern antenna of a third embodiment of the invention.
Figure 10:
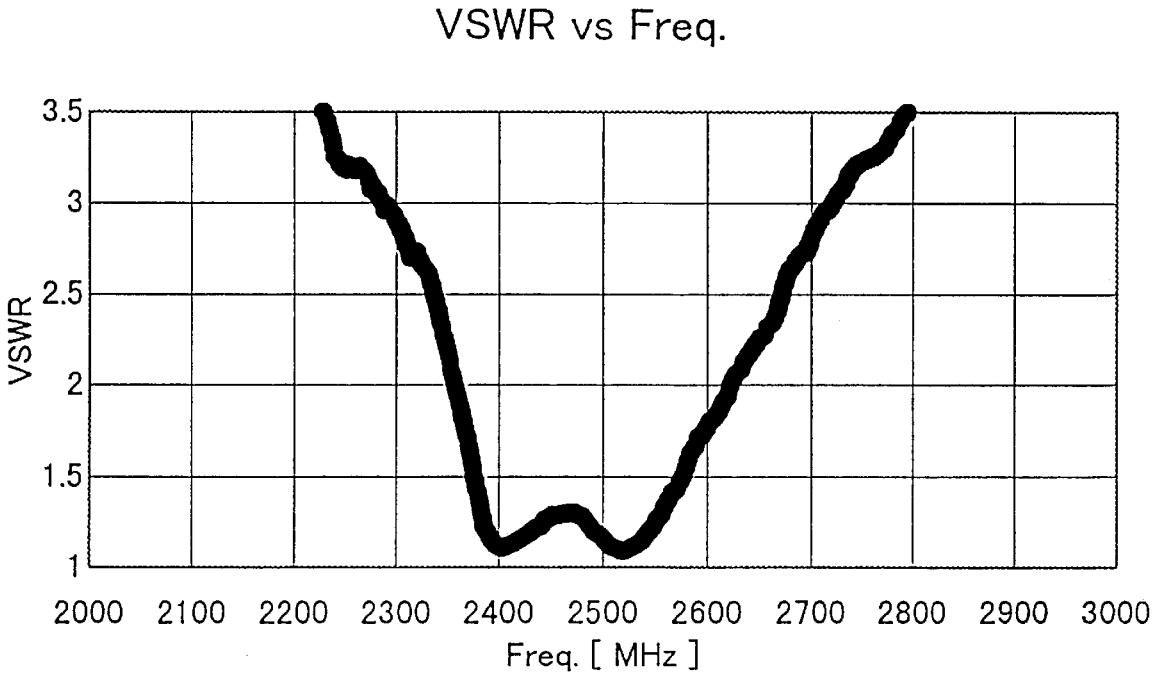
FIG. 10 is a diagram showing the frequency response of the voltage standing wave ratio of the laminate pattern antenna of the third embodiment.

A third embodiment of the invention will be described below with reference to the drawings. FIG. 9 is a sectional view of the laminate pattern antenna of this embodiment. FIG. 10 is a graph showing the frequency response of the voltage standing wave ratio (VSWR) of the laminate pattern antenna of this embodiment. In the following descriptions, such elements as are used for the same purposes as in the laminate pattern antenna of the first embodiment are identified with the same reference numerals, and their detailed explanations will not be repeated. It is to be noted that the sectional view of FIG. 9 is, like FIG. 3, a sectional view taken along line X-Y shown in FIGS. 1 and 2.

As shown in FIG. 9, the laminate pattern antenna of this embodiment is formed on and in a multilayer glass-epoxy circuit board 9 composed of three layers of glass-epoxy circuit boards 6*a,* 6*b,* and 6*c* (these circuit boards 6*a,* 6*b,* and 6*c* correspond to the circuit board 6). In the following descriptions, these circuit boards are called, from the top down, the first-layer circuit board 6*a*, the second-layer circuit board 6*b,* and the third-layer circuit board 6*c*. The multilayer circuit board 9 configured as described above has, like the circuit board 6 of the first embodiment, other circuit patterns also formed thereon.

In this multilayer circuit board 9, on each of the obverse-side surfaces of the second-layer and third-layer circuit boards 6*b* and 6*c,* an inverted-F-shaped antenna pattern 1 as shown in FIG. 1 is formed, and, on each of the obverse-side surface of the first-layer circuit board 6*a* and the reverse-side surface of the third-layer circuit board 6*c,* an inverted-L-shaped antenna pattern 2 is formed. The shape of the inverted-L-shaped antenna pattern shown in FIG. 2 corresponds to the shape of the inverted-L-shaped antenna pattern 2 formed on the obverse-side surface of the first-layer circuit board 6*a* as seen through the first-layer circuit board 6*a* from the reverse-side surface thereof.

The inverted-F-shaped antenna patterns 1 and the inverted-L-shaped antenna patterns 2 are formed in an edge portion of the multilayer circuit board 9, which has other circuit patterns and the like also formed thereon. On each of the obverse-side surfaces of the second-layer and third-layer circuit boards 6*b* and 6*c* are formed, as in the first embodiment (FIG. 1), a feeding transmission path 3 and a grounding conductor portion 4 with through holes 5 formed in a peripheral portion thereof. On the other hand, on each of the obverse-side surface of the first-layer circuit board 6*a* and the reverse-side surface of the third-layer circuit board 6*c* is formed, as in the first embodiment (FIG. 2), a grounding conductor portion 4 with through holes 5 formed in a peripheral portion thereof.

On each layer of this multilayer circuit board 9, the inverted-F-shaped antenna pattern 1 and the inverted-L-shaped antenna pattern 2 are, as in the first embodiment, so formed that their respective elongate patterns 1*a* and 2*a*, which are formed parallel to a side edge of the grounding conductor portion 4 that faces it, overlap each other with the material of the circuit board 9 sandwiched in between and in addition that the feeding conductor pattern 1*b* of the former, which is connected to the feeding transmission path 3, and the grounding conductor pattern 2*b* of the latter, which is connected to the grounding conductor portion 4, overlap each other with the material of the circuit board 9 sandwiched in between.

The inverted-F-shaped antenna patterns 1 and the inverted-L-shaped antenna patterns 2 constituting the laminate pattern antenna of this embodiment have the same features as their counterparts in the first embodiment, and therefore their detailed explanations will not be repeated, as given previously in connection with the first embodiment.

In a laminate pattern antenna built by combining together a plurality of inverted-F-shaped antenna patterns and a plurality of inverted-L-shaped antenna patterns in this way, the voltage standing wave ratio exhibits frequency response as shown in FIG. 10. Specifically, here, the maximum of the voltage standing wave ratio around the frequency 2,450 MHz within the usable frequency range is lower than in the first embodiment (FIG. 2). This makes it possible to achieve better impedance matching in a wide frequency range in which VSWR<2 and thereby transmit and receive communication signals in a wide frequency range.

This embodiment deals with an example in which the laminate pattern antenna is composed of a plurality of inverted-F-shaped antenna patterns and a plurality of inverted-L-shaped antenna patterns. However, it is also possible to build the laminate pattern antenna by forming on and in the multilayer circuit board 9 a plurality of inverted-L-shaped antenna patterns like the one 7 acting as a driven element in the second embodiment and a plurality of inverted-L-shaped antenna patterns like the one 8 acting as a passive element in the second embodiment. In the multilayer circuit board 9, the antenna patterns acting as driven elements and the antenna patterns acting as passive elements may be formed in any other manner than is specifically shown in the sectional view of FIG. 9 in terms of the order in which they overlap one another and in other aspects; for example, the laminate pattern antenna may be composed of one driven element and a plurality of passive elements having different path lengths.

Fourth Embodiment

Figure 11:
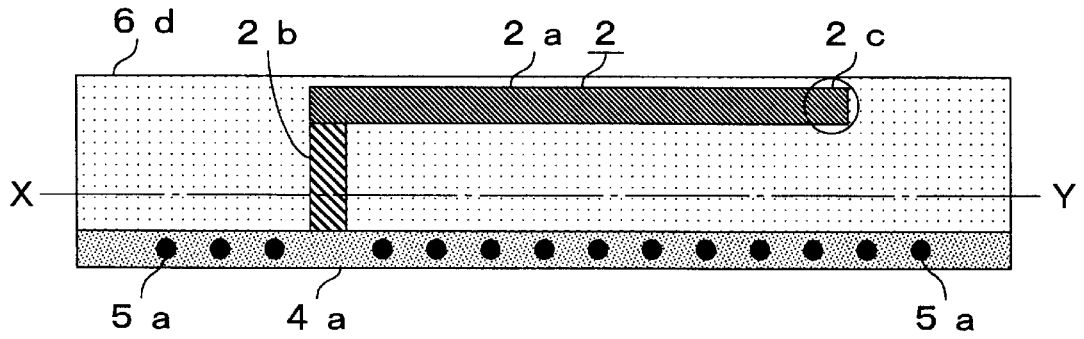
FIG. 11 is a plan view showing the configuration of the inverted-L-shaped antenna pattern in the laminate pattern antenna of a fourth embodiment of the invention.
Figure 12:
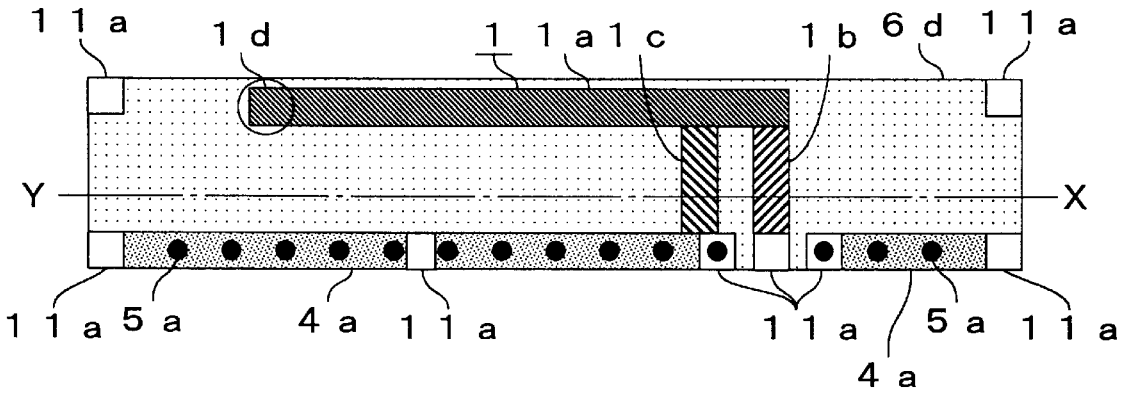
FIG. 12 is a plan view showing the configuration of the inverted-F-shaped antenna pattern in the laminate pattern antenna of the fourth embodiment.
Figure 13:
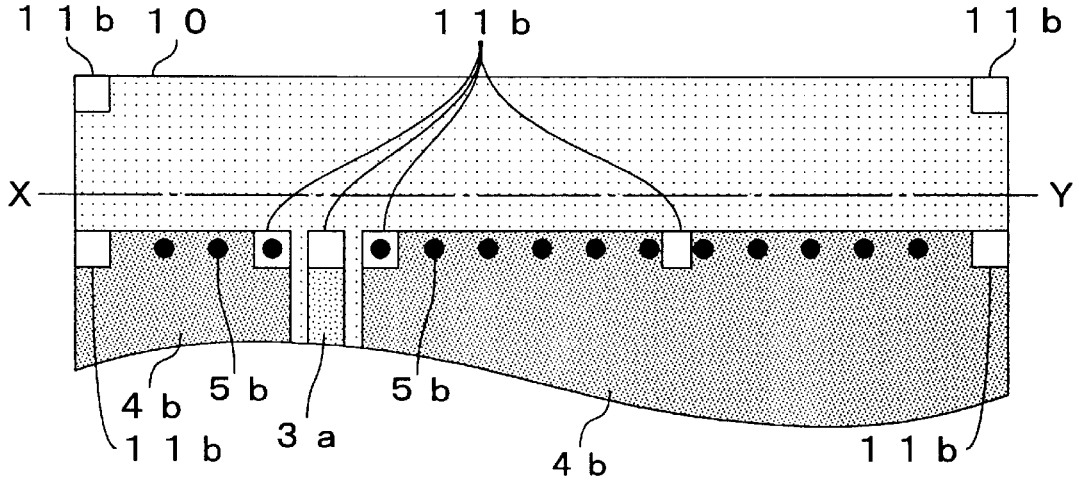
FIG. 13 is a plan view showing the configuration of the obverse-side surface of the circuit board on which the laminate pattern antenna of the fourth embodiment is formed.
Figure 14:
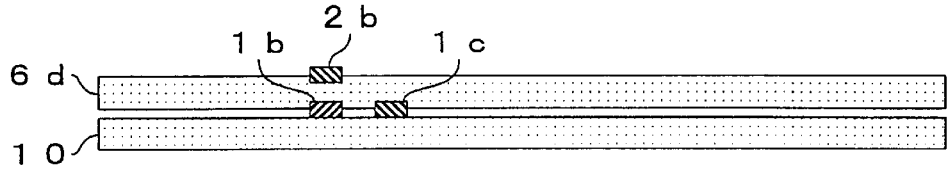
FIG. 14 is a sectional view showing the configuration of the laminate pattern antenna of the fourth embodiment.
Figure 15:
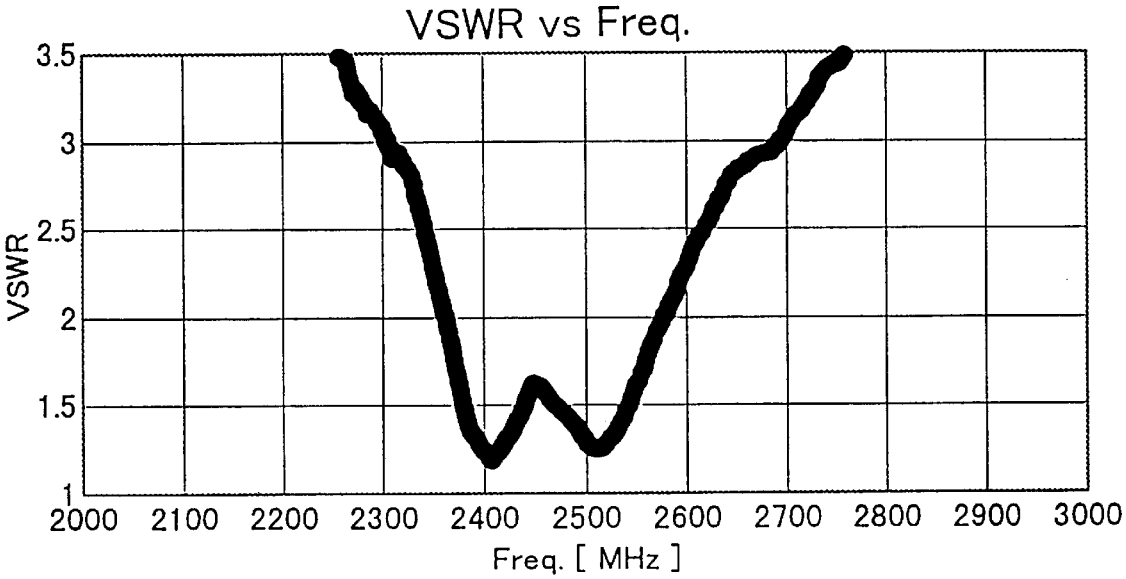
FIG. 15 is a diagram showing the frequency response of the voltage standing wave ratio of the laminate pattern antenna of the fourth embodiment.

A fourth embodiment of the invention will be described below with reference to the drawings. FIG. 11 is a diagram showing the obverse-side surface of the laminate pattern antenna of this embodiment. FIG. 12 is a diagram showing the reverse-side surface of the laminate pattern antenna of this embodiment. FIG. 13 is a diagram showing the obverse-side surface, together with the land patterns formed thereon, of the circuit board on which the laminate pattern antenna of this embodiment is mounted. FIG. 14 is a sectional view of the laminate pattern antenna of this embodiment, taken along line X-Y shown in FIGS. 11 to 13. FIG. 15 is a graph showing the frequency response of the voltage standing wave ratio (VSWR) of the laminate pattern antenna of this embodiment. In the following descriptions, such elements as are used for the same purposes as in the laminate pattern antenna of the first embodiment are identified with the same reference numerals, and their detailed explanations will not be repeated.

As opposed to the laminate pattern antennas of the first to third embodiments, which are formed on the same circuit board on which other circuit patterns and the like are formed, the laminate pattern antenna of this embodiment is formed on a circuit board separate from a circuit board on which other circuit patterns and the like are formed, and the circuit board on which the laminate pattern antenna is formed is mounted on the circuit board on which other circuit patterns and the like are formed.

Specifically, the laminate pattern antenna of this embodiment is composed of an inverted-L-shaped antenna pattern 2 formed on the obverse-side surface of a glass-epoxy circuit board 6*d* as shown in FIG. 11, and an inverted-F-shaped antenna pattern 1 formed on the reverse-side surface of the circuit board 6*d* as shown in FIG. 12. As shown in FIG. 11, on the obverse-side surface of the circuit board 6*d* is formed a strip-shaped grounding conductor portion 4*a*. As shown in FIG. 12, on the reverse-side surface of the circuit board 6*d* are formed two strip-shaped grounding conductor portions 4*a* and a plurality of land marks 11*a* for electrical connection with relevant portions of another circuit board 10 described later.

Here, as in the first embodiment (FIGS. 1 and 2), the grounding conductor portions 4*a* formed on the obverse-side and reverse-side surfaces of the circuit board 6*d* are so formed as to overlap each other with the circuit board 6*d*, i.e. the material thereof, sandwiched in between, and these grounding conductor portions 4*a* have through holes 5*a* formed therein. The land marks 11*a* formed on the reverse-side surface of the circuit board 6*d* are located in the four corners of the circuit board 6*d*, on the grounding conductor portions 4*a*, and between the two grounding conductor portions 4*a*.

The inverted-F-shaped antenna pattern 1 and the inverted-L-shaped antenna pattern 2 formed on the circuit board 6*d* as described above are, like the inverted-F-shaped antenna pattern and the inverted-L-shaped antenna pattern formed on the circuit board in the first embodiment, so formed that their respective elongate patterns 1*a* and 2*a*, and the feeding conductor pattern 1*b* of the former and the grounding conductor pattern 2*b* of the latter, overlap each other with the circuit board 6*d*, i.e. with the material thereof, sandwiched in between. Moreover, in the inverted-F-shaped antenna pattern 1 formed as described above, the feeding conductor pattern 1*b* is connected to the land pattern 11*a* that is located at the spot between the two grounding conductor portions 4*a*.

The inverted-F-shaped antenna pattern 1 and the inverted-L-shaped antenna pattern 2 constituting the laminate pattern antenna of this embodiment have the same features as their counterparts in the first embodiment, and therefore their detailed explanations will not be repeated, as given previously in connection with the first embodiment.

The laminate pattern antenna built by forming the inverted-F-shaped antenna pattern 1 and the inverted-L-shaped antenna pattern 2 on the circuit board 6*d* in this way is mounted on the surface of another circuit board 10. This circuit board 10 will be described below with reference to FIG. 13. On the obverse-side surface of the circuit board 10, as on the circuit board 6 of the first embodiment (FIG. 1), two grounding conductor portions 4*b* are formed with through holes 5 formed therein, and, between those two grounding conductor portions 4*b*, a feeding transmission path 3*a* is formed.

Moreover, for electrical connection with the land patterns 11*a* formed on the reverse-side surface of the circuit board 6*d*, land patterns 11*b* are formed in corners of the circuit board 10, on the grounding conductor portions 4*b*, and on the feeding transmission path 3*a*. Thus, the laminate pattern antenna is mounted on the circuit board 10 in such a way that the land patterns 11*a* formed on the circuit board 6*d*, specifically on the grounding conductor portions 4*a* and between the grounding conductor portions 4*a*, overlap the land patterns 11*b* formed on the circuit board 10, specifically on the grounding conductor portions 4*b* and on the feeding transmission path 3*a*.

As a result of this mounting, the grounding conductor portions 4*a* on the reverse-side surface of the circuit board 6*d* and the grounding conductor portions 4*b* on the obverse-side surface of the circuit board 10, and thus the through holes 5*a* formed in the grounding conductor portions 4*a* and the through holes 5*b* formed in the grounding conductor portions 4*b*, overlap each other. Moreover, in the inverted-F-shaped antenna pattern 1, the feeding conductor pattern 1*b* is electrically connected to the feeding transmission path 3*a* by way of the land patterns 11*a* and 11*b*, and the grounding conductor pattern 1*c* is electrically connected to the grounding conductor portions 4*b* by way of the grounding conductor portion 4*a* and the land patterns 11*a* and 11*b*. Furthermore, in the inverted-L-shaped antenna pattern 2, the grounding conductor pattern 2*b* is electrically connected to the grounding conductor portions 4*b* by way of the grounding conductor portion 4*a*, the through holes 5*a*, and the land patterns 11*a* and 11*b*.

When the laminate pattern antenna is mounted on the circuit board 10, the circuit board 10, the circuit board 6*d*, the inverted-F-shaped antenna pattern 1, and the inverted-L-shaped antenna pattern 2 are arranged as shown in a sectional view in FIG. 14. Specifically, the inverted-F-shaped antenna pattern 1 is formed between the obverse-side surface of the circuit board 10 and the reverse-side surface of the circuit board 6*d*, and the inverted-L-shaped antenna pattern 2 is formed on the obverse-side surface of the circuit board 6*d*.

In the laminate pattern antenna configured as described above, the voltage standing wave ratio exhibits frequency response as shown in FIG. 15, offering, as in the first embodiment (FIG. 4), a wider frequency range in which VSWR<2 than is obtained conventionally (FIG. 22). This makes it possible to achieve satisfactory impedance matching in a wide frequency range and thereby transmit and receive communication signals in a wide frequency range.

In this embodiment, the laminate pattern antenna that is mounted on another circuit board has a configuration similar to that of the laminate pattern antenna of the first embodiment. However, it is also possible to mount a laminate pattern antenna having a configuration similar to that of the laminate pattern antenna of the second or third embodiment on another circuit board.

Figure 16:
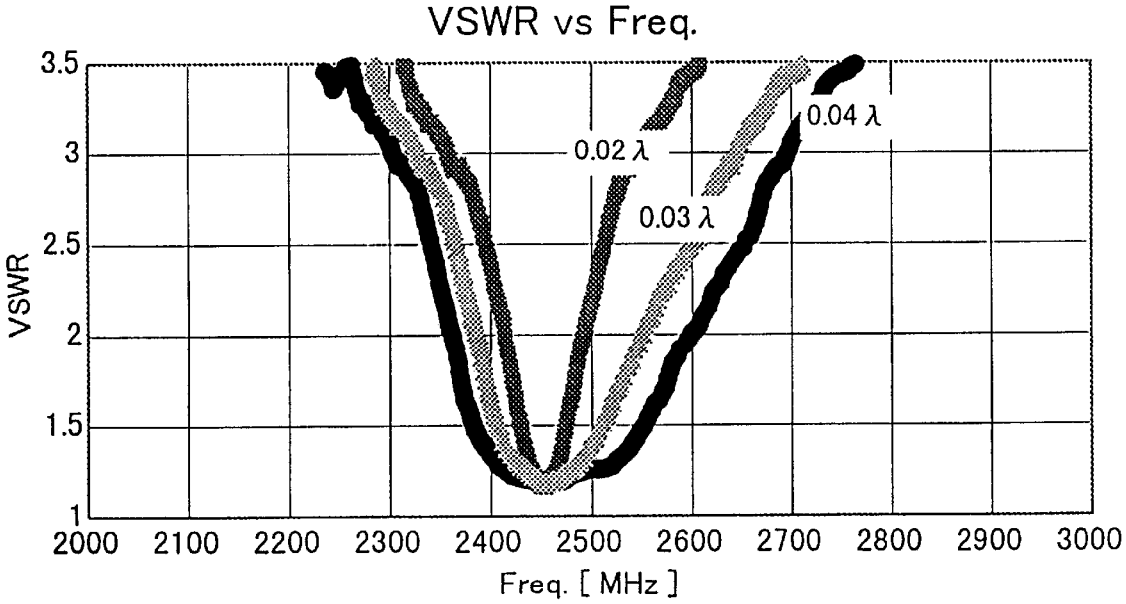
FIG. 16 is a diagram showing how the position of the laminate pattern antenna affects the frequency response of the voltage standing wave ratio.

In the laminate pattern antennas of the first to fourth embodiments described above, the gap between the laminate pattern antenna and the grounding conductor portion relates to the frequency response of the voltage standing wave ratio of the laminate pattern antenna in such a way that, as shown in FIG. 16, the wider the gap, the wider the usable frequency range in which VSRW<2. If the gap between the laminate pattern antenna and the grounding conductor portion is made narrower than $0.02\times\lambda$, the usable frequency range of the laminate pattern antenna becomes still narrower than is shown in FIG. 16, and thus the resulting laminate pattern antenna functions poorly as an antenna.

Accordingly, by making the gap between the laminate pattern antenna and the grounding conductor portion sufficiently wide, specifically $0.02\times\lambda$ or wider, it is possible to transmit and receive communication signals in a wide frequency range. FIG. 16 is a graph showing the results of simulations performed using the laminate pattern antenna of the second embodiment, and shows the frequency response of the voltage standing wave ratio of the laminate pattern antenna when the gap between each of the elongate patterns 7*a* and 8*a* of the inverted-L-shaped antenna patterns 7 and 8 and the grounding conductor portion 4 is $0.02\times\lambda$, $0.03\times\lambda$, and $0.04\times\lambda$.

Figure 17A:
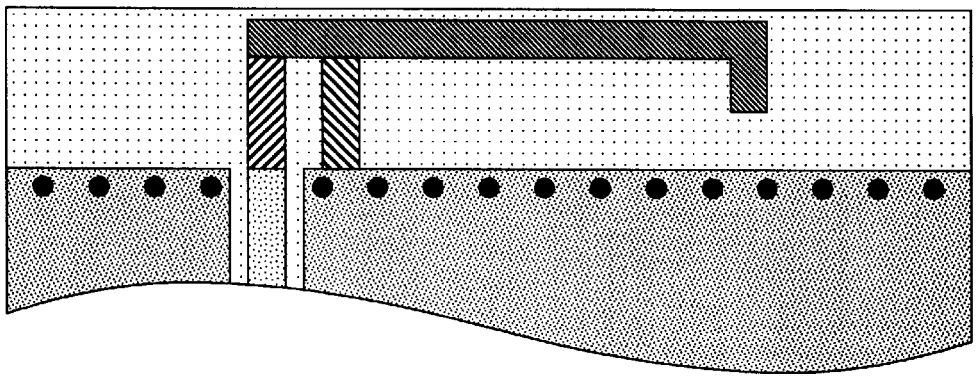
FIGS. 17A and 17B are plan views showing the configurations of antenna patterns with a hook-shaped and a meandering pattern, respectively.
Figure 17B:
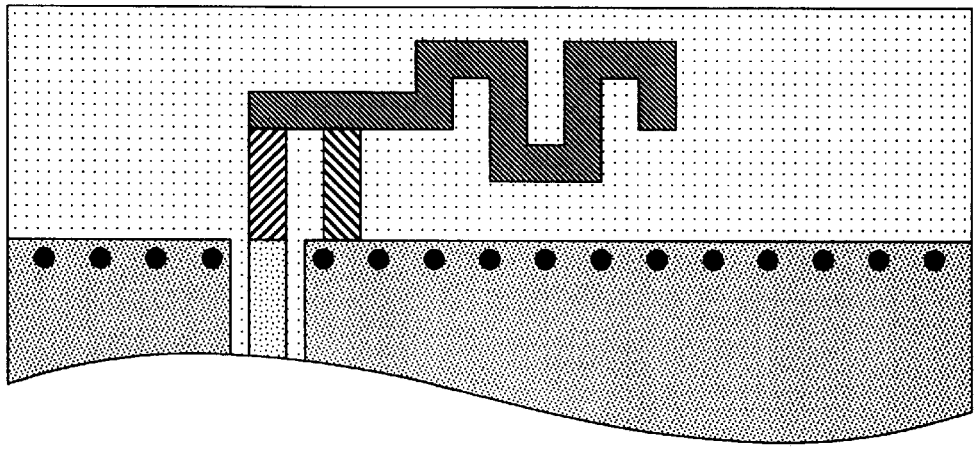

The first to fourth embodiments deal with examples in which the inverted-F-shaped and inverted-L-shaped antenna patterns have rectilinear elongate patterns. However, those antenna patterns may be formed in any other shape than is specifically described above; for example, they may have a hook-shaped pattern with the open end of the elongate pattern bent perpendicularly toward the grounding conductor portion as shown in FIG. 17A, or a meandering pattern with an open-end portion of the elongate pattern bent in a meandering shape as shown in FIG. 17B. These arrangements help reduce the area of the region that needs to be secured for each antenna pattern and thereby make the antenna as a whole compact. Although FIGS. 17A and 17B show driven elements each provided with a feeding conductor pattern and a grounding conductor pattern, these arrangements may also be applied to a driven element provided only with a feeding conductor pattern, or to a passive element provided only with a grounding conductor pattern.

Figure 18A:
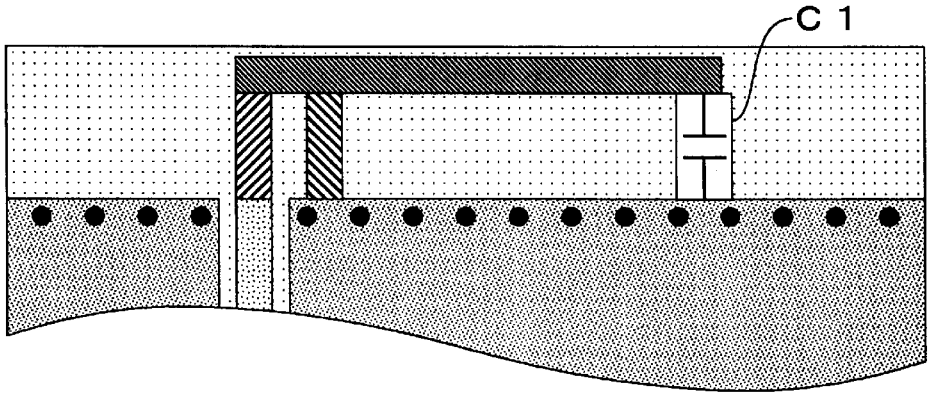
FIGS. 18A and 18B are plan views showing the configurations of antenna patterns with a chip capacitor placed thereon.
Figure 18B:
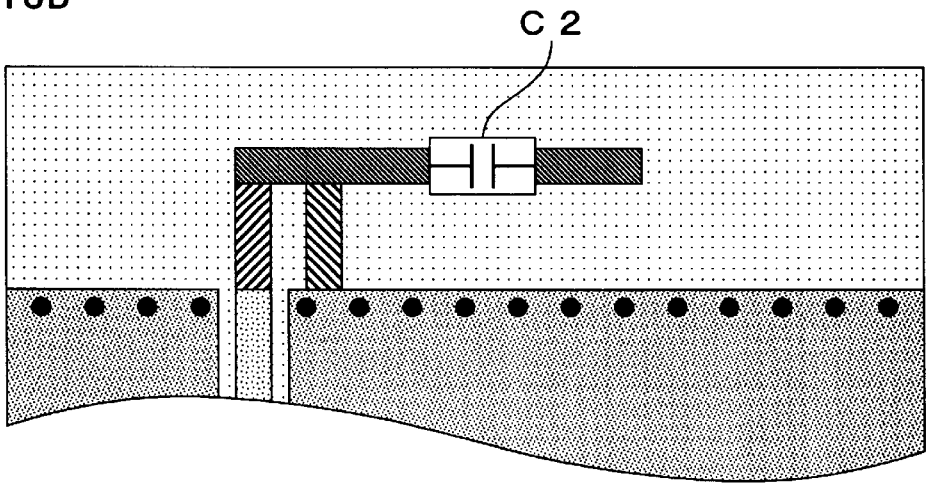

It is also possible to place a chip capacitor C1 between the open end of the elongate pattern and the grounding conductor portion as shown in FIG. 18A, or to divide the elongate pattern into two parts and place a chip capacitor C2 between them as shown in FIG. 18B. Placing a chip capacitor C1 or C2, which provides capacitance, in this way helps shorten the path length of each antenna pattern. This helps reduce the area of the region that needs to be secured for each antenna pattern and thereby make the antenna as a whole compact. Although FIGS. 18A and 18B show driven elements each provided with a feeding conductor pattern and a grounding conductor pattern, these arrangements may also be applied to a driven element provided only with a feeding conductor pattern, or to a passive element provided only with a grounding conductor pattern.

In the embodiments, the laminate pattern antenna is formed on a glass-epoxy circuit board, which has a comparatively low dielectric constant. However, for example, in antennas for transmitting and receiving high-frequency signals having frequencies of 3 GHz or above, it is also possible to use a Teflon-glass circuit board, which offers a still lower dielectric constant and a low dielectric loss.

The individual antenna patterns, i.e. the inverted-F-shaped and inverted-L-shaped antenna patterns, are formed through patterning based on etching, printing, or the like just as circuit patterns are formed on ordinary circuit boards.

An Example of Wireless Device Equipped with an Antenna Embodying the Invention

Figure 19:
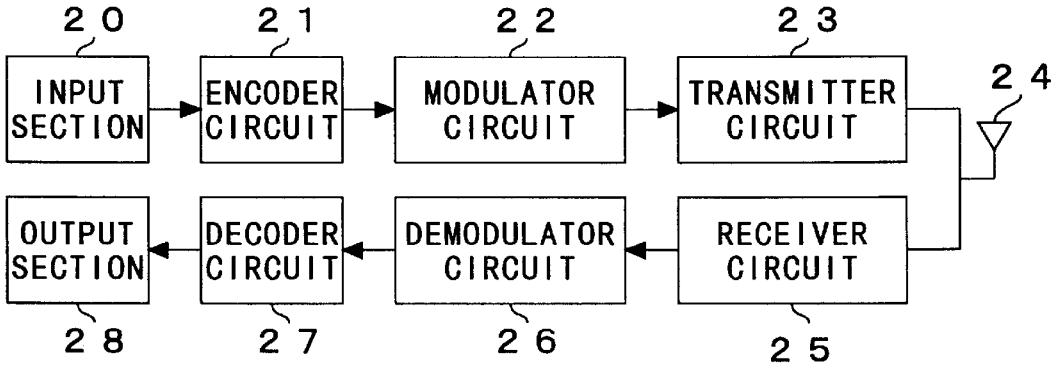
FIG. 19 is a block diagram showing an example of the internal configuration of a wireless device embodying the invention.
Figure 20A:
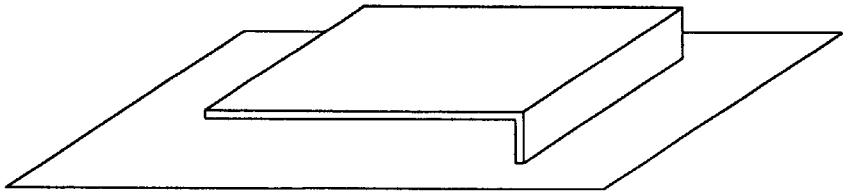
FIGS. 20A and 20B are top views showing the configurations of conventional inverted-F-shaped antennas.
Figure 20B:
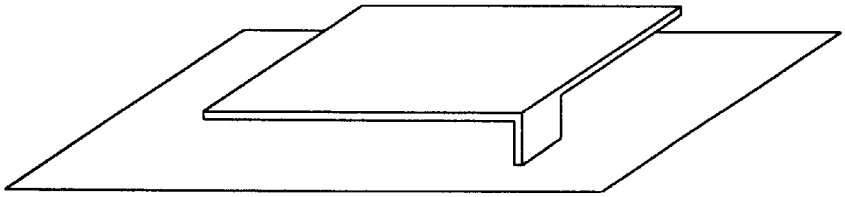
Figure 21A:
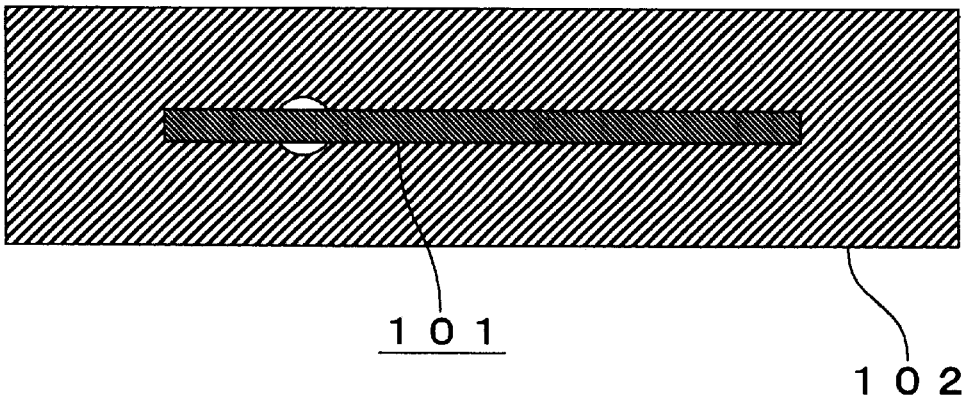
FIGS. 21A and 21B are sectional views showing the configurations of conventional inverted-F-shaped antennas.
Figure 21B:
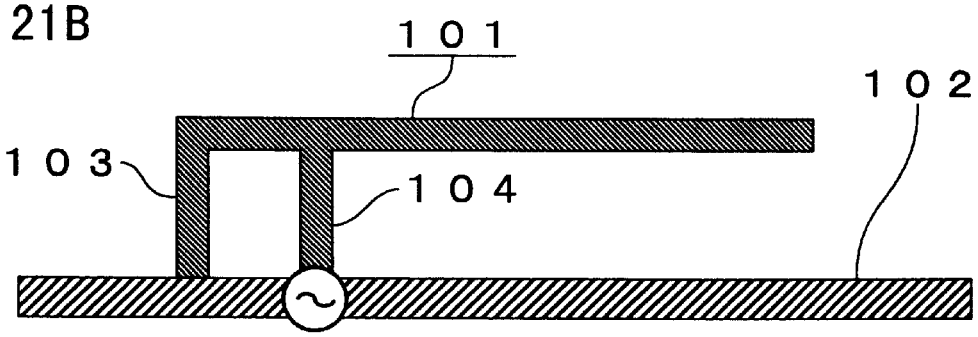

Hereinafter, a wireless device equipped with an antenna configured as in one of the first to fourth embodiments will be described. FIG. 19 is a block diagram showing the internal configuration of the wireless device of this embodiment.

The wireless device shown in FIG. 19 has an input section 20 to which sound, images, or data is fed from an external device, an encoder circuit 21 for encoding the data fed to the input section 20, a modulator circuit 22 for modulating the data encoded by the encoder circuit 21, a transmitter circuit 23 for amplifying the signal modulated by the modulator circuit 22 to produce a stable signal to be transmitted, an antenna 24 for transmitting and receiving signals, a receiver circuit 25 for amplifying the signals received by the antenna 24 and permitting only the signal within a predetermined frequency range to pass through, a demodulator circuit 26 for detecting and thereby demodulating the received signal amplified by the receiver circuit 25, a decoder circuit 27 for decoding the signal fed from the demodulator circuit 26, and an output section 28 for outputting the sound, images, or data decoded by the decoder circuit 27.

In this wireless device, first, the sound, images, or data fed to the input section 20 such as a microphone, a camera, or a keyboard is encoded by the encoder circuit 21. Then, by the modulator circuit 22, the encoded data is modulated with a carrier wave having a predetermined frequency. Then, the modulated signal is amplified by the transmitter circuit 23. The signal is then radiated as a transmitted signal by the antenna 24, which is configured as a laminate pattern antenna like those of the first to fourth embodiments described previously.

On the other hand, when signals are received by the antenna 24, first, the signals are amplified by the receiver circuit 25, and, by a filter circuit or the like provided in this receiver circuit 25, only the signal within a predetermined frequency range is permitted to pass through, and is thus fed to the demodulator circuit 26. Then, the demodulator circuit 26 detects and thereby demodulates the signal fed from the receiver circuit 25, and then the demodulated signal is decoded by the decoder circuit 27. The sound, images, or data obtained as a result of the decoding by the decoder circuit 27 is then output to the output section 28 such as a loudspeaker or a display.

In this wireless communication device, when a laminate pattern antenna like those of the first to third embodiments is used as the antenna 24, on the same circuit board on which the antenna 24 is formed, the encoder circuit 21, modulator circuit 22, transmitter circuit 23, receiver circuit 25, demodulator circuit 26, decoder circuit 27 are also formed as circuit patterns. On the other hand, when a laminate pattern antenna like that of the fourth embodiment is used as the antenna 24, the circuit board on which the antenna 24 is formed is mounted on another circuit board on which the encoder circuit 21, modulator circuit 22, transmitter circuit 23, receiver circuit 25, demodulator circuit 26, decoder circuit 27 are formed as circuit patterns, with the land patterns formed on the two circuit boards connected together.

The embodiment described just above deals with an example of a wireless device in which the laminate pattern antenna of one of the first to fourth embodiments described previously is used as an antenna for both transmission and reception. However, the laminate pattern antenna of any of those embodiments may be used as an antenna for reception only in a wireless receiver device, or as an antenna for transmission only in a wireless transmitter device.

According to the present invention, a laminate pattern antenna is composed of antenna patterns. This eliminates the need to secure a three-dimensional space as required by a conventional antenna, and in addition, by bending the antenna patterns constituting an antenna, it is possible to reduce the area of the region that needs to be secured to form those antenna patterns. This not only helps miniaturize antennas, but also contributes to the miniaturization of wireless devices that incorporate laminate pattern antennas embodying the invention. Moreover, the antenna patterns that constitute the laminate pattern antenna act as a plurality of driven and passive elements. This makes it possible to achieve impedance matching in a wide frequency range, and thus realize an antenna that can transmit and receive signals in a wide frequency range.

What is claimed is:

1. A laminate pattern antenna formed on a circuit board, comprising:

a first antenna pattern formed as a driven element on a first surface of the circuit board; and a second antenna pattern formed as a passive element on a second surface of the circuit board, wherein the area of the circuit board is substantially greater than the area of either of the first antenna pattern and the second antenna pattern, wherein one end of the first antenna pattern is used as a feeding portion, another end of the first antenna pattern is used as an open end, and a bent portion is formed between the feeding portion and the open end of the first antenna pattern, and wherein one end of the second antenna pattern is used as a grounding portion, another end of the second antenna pattern is used as an open end, and a bent portion is formed between the grounding portion and the open end of the second antenna pattern.

2. A laminate pattern antenna as claimed in claim 1, wherein the circuit board has a grounding conductor portion, and wherein, for each of the first and second antenna patterns, if an effective wavelength of the antenna at a center frequency of a usable frequency range thereof is assumed to be $\lambda$, a pattern formed between the bent portion and the open end is located $0.02\times\lambda$ or more away from a side edge of the grounding conductor portion that faces the pattern.

3. A laminate pattern antenna as claimed in claim 1, wherein the first antenna pattern is an inverted-F-shaped pattern grounded at a point between the feeding portion and the open end.

4. A laminate pattern antenna as claimed in claim 3, wherein, in the first antenna pattern, a pattern between the bent portion and the feeding portion forms a feeding conductor pattern, the pattern between the bent portion and the open end forms an elongate pattern, and a grounding conductor pattern is formed that is connected at one end to the grounding conductor portion formed on the circuit board and at another end to the elongate pattern, wherein the grounding conductor pattern is formed closer to the open end than the feeding conductor pattern is.

5. A laminate pattern antenna as claimed in claim 4, wherein the elongate pattern is formed substantially parallel to a side edge of the grounding conductor portion that faces the elongate pattern, and the feeding conductor pattern and the grounding conductor pattern are formed substantially perpendicularly to the elongate pattern.

6. A laminate pattern antenna as claimed in claim 1, wherein the first antenna pattern is an inverted-L-shaped pattern.

7. A laminate pattern antenna as claimed in claim 6, wherein, in the first antenna pattern, a pattern between the bent portion and the feeding portion forms a feeding conductor pattern, and a pattern between the bent portion and the open end forms an elongate pattern, and wherein the elongate pattern is formed substantially parallel to the grounding conductor portion formed on the circuit board, and the feeding conductor pattern is formed substantially perpendicularly to the elongate pattern.

8. A laminate pattern antenna as claimed in claim 1, wherein, in the first antenna pattern, a pattern formed between the open end and the bent portion is a hook-shaped pattern with a bend formed at the open end or a pattern of which a part is bent in a meandering shape.

9. A laminate pattern antenna as claimed in claim 8, wherein the first antenna pattern is a pattern grounded at a point between the feeding portion and the open end.

10. A laminate pattern antenna as claimed in claim 1, wherein the second antenna pattern is an inverted-L-shaped pattern.

11. A laminate pattern antenna as claimed in claim 10, wherein, in the second antenna pattern, a pattern between the bent portion and the grounding portion forms a grounding conductor pattern, and a pattern between the bent portion and the open end forms an elongate pattern, and wherein the elongate pattern is formed substantially parallel to a side edge of the grounding conductor portion formed on the circuit board that faces the elongate pattern, and the grounding conductor pattern is formed substantially perpendicularly to the elongate pattern.

12. A laminate pattern antenna as claimed in claim 1, wherein, in the second antenna pattern, a pattern formed between the open end and the bent portion is a hook-shaped pattern with a bend formed at the open end or a pattern of which a part is bent in a meandering shape.

13. A laminate pattern antenna as claimed in claim 1, wherein, if an effective wavelength of the antenna at a center frequency of a usable frequency range thereof is assumed to be $\lambda$, the first antenna pattern has a path length L1 that fulfills $0.236\times\lambda L1<0.25\times\lambda$.

14. A laminate pattern antenna as claimed in claim 1, wherein, if an effective wavelength of the antenna at a center frequency of a usable frequency range thereof is assumed to be $\lambda$, the second antenna pattern has a path length L2 that fulfills $0.25\times\lambda\leqq L2<0.273\times\lambda$.

15. A laminate pattern antenna as claimed in claim 1, wherein a chip capacitor is placed on at least one of the first and second antenna patterns.

16. A laminate pattern antenna as claimed in claim 1, wherein the first and second antenna patterns are so formed as to overlap each other with a material of the circuit board sandwiched in between.

17. A laminate pattern antenna as claimed in claim 1, wherein the first and second antenna patterns are so formed in an edge portion of the circuit board.

18. A laminate pattern antenna as claimed in claim 1, wherein the first and second antenna patterns are formed in an edge portion of the circuit board.

19. A laminate pattern antenna as claimed in claim 1, wherein the circuit board is a glass-epoxy or Teflon-glass circuit board.

20. A laminate pattern antenna as claimed in claim 1, wherein a pattern of another circuit, in addition to the first and second antenna patterns, is formed on the circuit board.

21. A laminate pattern antenna as claimed in claim 1, wherein a land pattern is formed on the circuit board for electrical connection with another circuit board.

22. A laminate pattern antenna formed on and in a multilayer circuit board, comprising:

a plurality of first antenna patterns formed as a driven element on surfaces of or at interfaces between layers constituting the circuit board; and a plurality of second antenna patterns formed as a passive element on surfaces of or at interfaces between the layers constituting the circuit board.

23. A laminate pattern antenna as claimed in claim 22, wherein the plurality of first and second antenna patterns are formed on different surfaces of or at different interfaces between the layers.

24. A laminate pattern antenna as claimed in claim 22, wherein one end of the first antenna patterns is used as a feeding portion, another end of the first antenna patterns is used as an open end, and a bent portion is formed between the feeding portion and the open end of the first antenna patterns, and wherein one end of the second antenna patterns is used as a grounding portion, another end of the second antenna patterns is used as an open end, and a bent portion is formed between the grounding portion and the open end of the second antenna patterns.

25. A laminate pattern antenna as claimed in claim 24, wherein the circuit board has a grounding conductor portion, and wherein, for each of the first and second antenna patterns, if an effective wavelength of the antenna at a center frequency of a usable frequency range thereof is assumed to be $\lambda$, a pattern formed between the bent portion and the open end is located $0.02\times\lambda$, or more away from a side edge of the grounding conductor portion that faces the pattern.

26. A laminate pattern antenna as claimed in claim 24, wherein the first antenna patterns are each an inverted-F-shaped pattern grounded at a point between the feeding portion and the open end.

27. A laminate pattern antenna as claimed in claim 26, wherein, in each of the first antenna patterns, a pattern between the bent portion and the feeding portion forms a feeding conductor pattern, the pattern between the bent portion and the open end forms an elongate pattern, and a grounding conductor pattern is formed that is connected at one end to the grounding conductor portion formed on the circuit board and at another end to the elongate pattern, wherein the grounding conductor pattern is formed closer to the open end than the feeding conductor pattern is.

28. A laminate pattern antenna as claimed in claim 27, wherein the elongate pattern is formed substantially parallel to a side edge of the grounding conductor portion that faces the elongate pattern, and the feeding conductor pattern and the grounding conductor pattern are formed substantially perpendicularly to the elongate pattern.

29. A laminate pattern antenna as claimed in claim 24, wherein the first antenna patterns are each an inverted-L-shaped pattern.

30. A laminate pattern antenna as claimed in claim 29, wherein, in each of the first antenna patterns, a pattern between the bent portion and the feeding portion forms a feeding conductor pattern, and a pattern between the bent portion and the open end forms an elongate pattern, and wherein the elongate pattern is formed substantially parallel to the grounding conductor portion formed on the circuit board, and the feeding conductor pattern is formed substantially perpendicularly to the elongate pattern.

31. A laminate pattern antenna as claimed in claim 24, wherein, in each of the first antenna patterns, a pattern formed between the open end and the bent portion is a hook-shaped pattern with a bend formed at the open end or a pattern of which a part is bent in a meandering shape.

32. A laminate pattern antenna as claimed in claim 31, wherein the first antenna patterns are each a pattern grounded at a point between the feeding portion and the open end.

33. A laminate pattern antenna as claimed in claim 24, wherein the second antenna patterns are each an inverted-L-shaped pattern.

34. A laminate pattern antenna as claimed in claim 33, wherein, in each of the second antenna patterns, a pattern between the bent portion and the grounding portion forms a grounding conductor pattern, and a pattern between the bent portion and the open end forms an elongate pattern, and wherein the elongate pattern is formed substantially parallel to a side edge of the grounding conductor portion formed on the circuit board that faces the elongate pattern, and the grounding conductor pattern is formed substantially perpendicularly to the elongate pattern.

35. A laminate pattern antenna as claimed in claim 24, wherein, in each of the second antenna patterns, a pattern formed between the open end and the bent portion is a hook-shaped pattern with a bend formed at the open end or a pattern of which a part is bent in a meandering shape.

36. A laminate pattern antenna as claimed in claim 22, wherein, if an effective wavelength of the antenna at a center frequency of a usable frequency range thereof is assumed to be $\lambda$, the first antenna patterns have a path length L1 that fulfills $0.236\times\lambda \leqq L1 < 0.25\times\lambda$.

37. A laminate pattern antenna as claimed in claim 22, wherein, if an effective wavelength of the antenna at a center frequency of a usable frequency range thereof is assumed to be $\lambda$, the second antenna patterns have a path length L2 that fulfills $0.25\times\lambda \leqq L2 < 0.273\times\lambda$.

38. A laminate pattern antenna as claimed in claim 22, wherein a chip capacitor is placed on either the first or second antenna patterns.

39. A laminate pattern antenna as claimed in claim 22, wherein the first and second antenna patterns are so formed as to overlap each other with materials of the circuit board sandwiched in between.

40. A laminate pattern antenna as claimed in claim 22, wherein the first and second antenna patterns each have a pattern line width of 0.5 mm or more.

41. A laminate pattern antenna as claimed in claim 22, wherein the first and second antenna patterns are formed in an edge portion of the circuit board.

42. A laminate pattern antenna as claimed in claim 22, wherein the circuit board is a glass-epoxy or Teflon-glass circuit board.

43. A laminate pattern antenna as claimed in claim 22, wherein a pattern of another circuit, in addition to the first and second antenna patterns, is formed on the circuit board.

44. A laminate pattern antenna as claimed in claim 22, wherein a land pattern is formed on the circuit board for electrical connection with another circuit board.

45. A wireless communication device comprising:

a laminate pattern antenna that permits at least either transmission or reception of a communication signal to or from an external device, the laminate pattern antenna comprising:

a first antenna pattern formed as a driven element on a first surface of the circuit board; and a second antenna pattern formed as a passive element on a second surface of the circuit board, wherein the area of the circuit board is substantially greater than the area of either of the first antenna pattern and the second antenna pattern, wherein one end of the first antenna pattern is used as a feeding portion, another end of the first antenna pattern is used as an open end, and a bent portion is formed between the feeding portion and the open end of the first antenna pattern, and wherein one end of the second antenna pattern is used as a grounding portion, another end of the second antenna pattern is used as an open end, and a bent portion is formed between the grounding portion and the open end of the second antenna pattern.

46. A wireless communication device comprising:

a laminate pattern antenna that permits at least either transmission or reception of a communication signal to or from an external device, the laminate pattern antenna comprising:

a plurality of first antenna patterns formed as a driven element on surfaces of or at interfaces between layers constituting the circuit board; and a plurality of second antenna patterns formed as a passive element on surfaces of or at interfaces between the layers constituting the circuit board.

* * * * *